US007337644B2

(12) United States Patent
Pang

(10) Patent No.: US 7,337,644 B2
(45) Date of Patent: Mar. 4, 2008

(54) ASSEMBLED WORKSTATION

(75) Inventor: Shao-Yu Pang, Taichung (TW)

(73) Assignee: Proking Heating Technologies International Corp. (TW)

( * ) Notice: Subject to any disclaimer, the term of this patent is extended or adjusted under 35 U.S.C. 154(b) by 119 days.

(21) Appl. No.: 11/418,437

(22) Filed: May 4, 2006

(65) Prior Publication Data

US 2007/0256468 A1 Nov. 8, 2007

(51) Int. Cl.
*B21D 37/16* (2006.01)

(52) U.S. Cl. ..... 72/342.1; 72/95; 72/420; 72/342.94; 219/637; 219/652; 414/14

(58) Field of Classification Search ..... 72/31.03, 72/54, 77, 80, 95, 98, 250, 251, 252, 342.1, 72/342.94, 342.96, 405.01, 405.04, 405.07, 72/419, 420, 421, 428; 414/14, 17, 18; 219/637, 219/652; 82/126, 127
See application file for complete search history.

(56) References Cited

U.S. PATENT DOCUMENTS 4,184,798 A * 1/1980 Laughlin ..... 414/16
4,472,987 A * 9/1984 Johnson ..... 82/127
4,640,115 A * 2/1987 Hartmann et al. ..... 72/98
5,115,702 A * 5/1992 Link ..... 82/126
5,117,672 A * 6/1992 Collet ..... 72/420
5,970,830 A * 10/1999 von Niederhausern ..... 82/127

* cited by examiner

*Primary Examiner*—Ed Tolan
(74) *Attorney, Agent, or Firm*—Jackson Walker, LLP

(57) ABSTRACT

A workstation has a base, a conveying device, a driving assembly and a working device. The base is composed of multiple supporting frames. The conveying device is mounted on the base and has a rail, a moving base, a motor, a pushing rod and two rotating rods. The rotating rods are rotatably mounted on the base and are parallel with each other. Each rotating rod is composed of multiple connecting rods and multiple connecting elements. The connecting rods are combined with each other, and the connecting elements are mounted respectively between the connecting rods to connect adjacent connecting rods together. The driving assembly is mounted on the base to drive the rotating rods to rotate along a same direction. The working device is mounted on the base to process a manufacturing process to a worked object.

20 Claims, 7 Drawing Sheets

ASSEMBLED WORKSTATION

BACKGROUND OF THE INVENTION

1. Field of the Invention

The present invention relates to a workstation, and more particularly to an assembled workstation that is adjustable in size to fit with different worked objects and is versatile in use.

2. Description of Related Art

A conventional workstation substantially comprises a base and a working device, such as an electromagnetic induction device or a thermal treatment device mounted on the base. A conveying device is mounted on the base to push a worked object, such as a threaded rod and transports the working object to pass through the working device. Accordingly, the worked object can be processed with a desired manufacturing process by the working device.

However, the base of the conventional workstation has a fixed and predetermined size and shape based on a corresponding worked object and is not adjustable to fit with different worked objects, such that the conventional workstation is not versatile in use.

To overcome the shortcomings, the present invention tends to provide a workstation to mitigate or obviate the aforementioned problems.

SUMMARY OF THE INVENTION

The main objective of the invention is to provide a workstation that is adjustable in size to fit with different worked objects and is versatile in use. The workstation has a base, a conveying device, a driving assembly and a working device. The base has a top and is composed of multiple supporting frames. The conveying device is mounted on the base and has a rail, a moving base, a motor, a pushing rod and two rotating rods. The rail is mounted on and arranged parallelly with the base. The moving base is movably mounted on the rail. The motor is mounted on the moving base to drive the moving base to move along the rail. The pushing rod is securely attached to the moving base and corresponds to and is parallel with the top of the base. The rotating rods are rotatably mounted on the top of the base and are parallel with each other. Each rotating rod is composed of multiple connecting rods and multiple connecting elements. The connecting rods are combined with each other, and the connecting elements are mounted respectively between the connecting rods to connect adjacent connecting rods together. The driving assembly is mounted on the base to drive the rotating rods to rotate along a same direction. The working device is mounted on the base to process a manufacturing process to a worked object.

Other objects, advantages and novel features of the invention will become more apparent from the following detailed description when taken in conjunction with the accompanying drawings.

DETAILED DESCRIPTION OF PREFERRED EMBODIMENT

Figure 1:
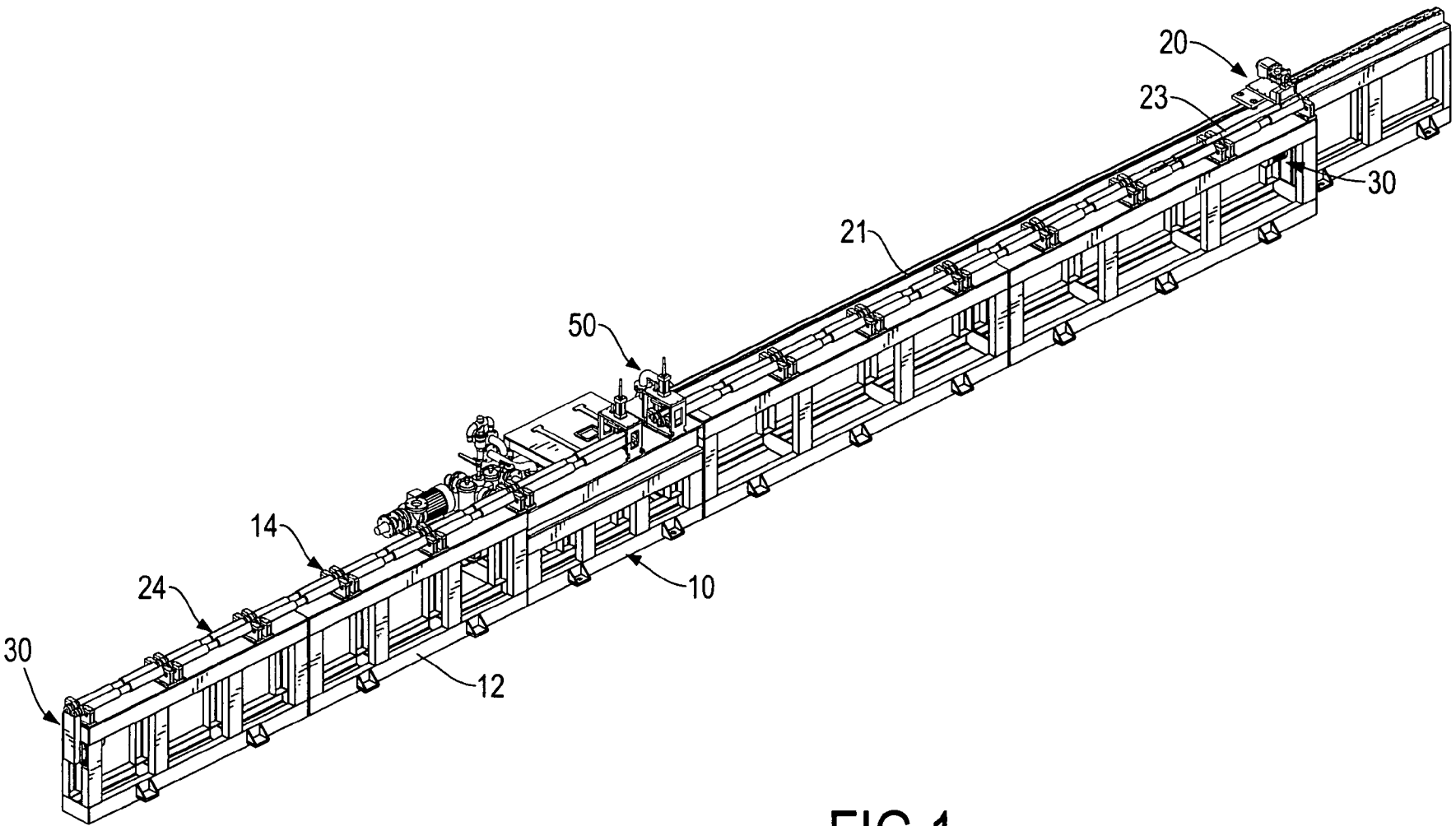
FIG. 1 is a perspective view of a workstation in accordance with the present invention.
Figure 5:
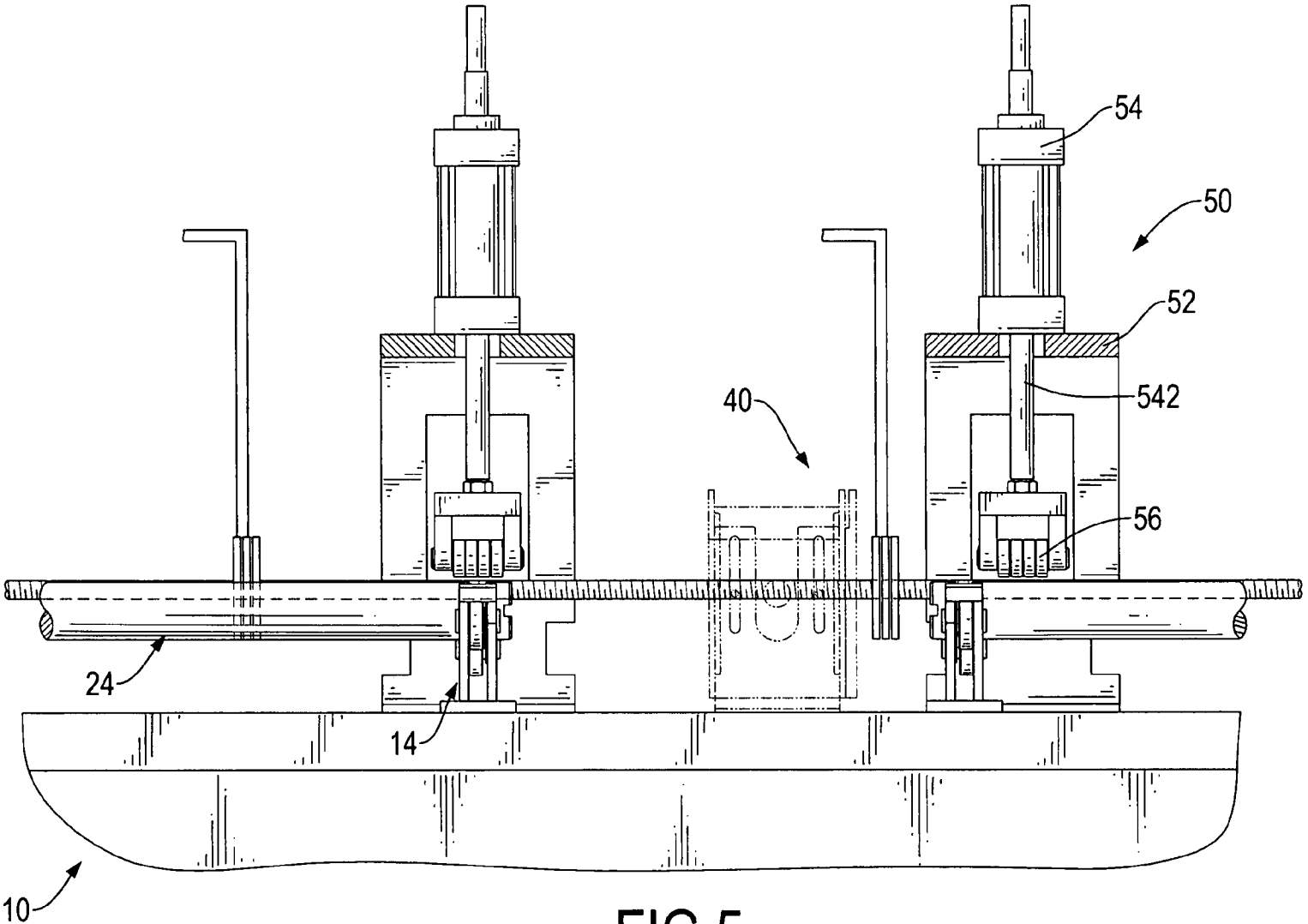
FIG. 5 is a side plan view of the base and positioning devices of the workstation in FIG. 1.

With reference to FIGS. 1 and 5, a workstation for a workstation in accordance with the present invention comprises a base (10), a conveying device (20), a driving assembly and a working device (40). The base (10) has a top and is composed of multiple supporting frames (12). The supporting frames (12) are combined with each other to form an elongated base (10).

The working device (40) is mounted on the base (10) to process a manufacturing process to a worked object. The working device (40) can be an electromagnetic induction device or a thermal treatment device.

Figure 2:
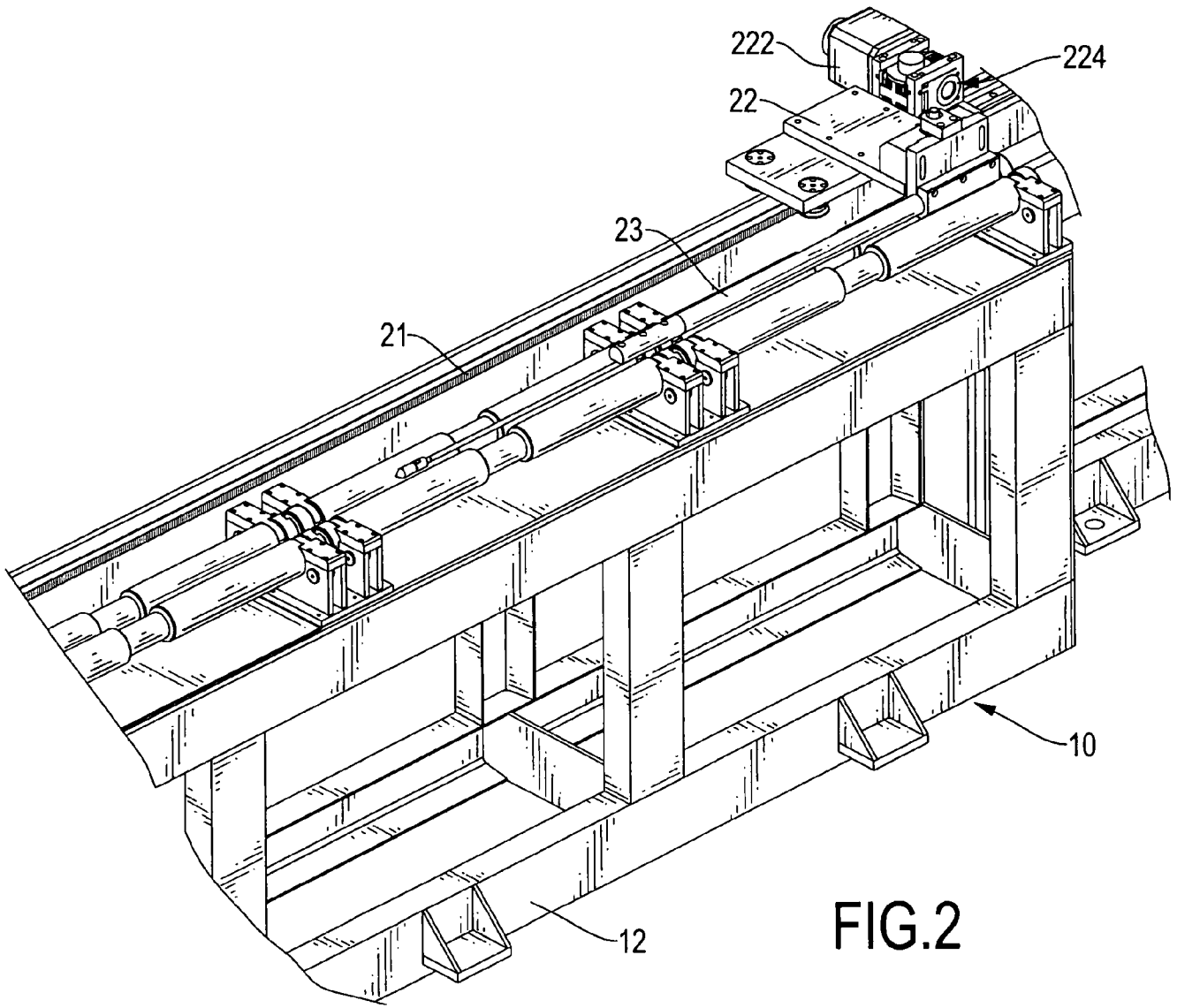
FIG. 2 is a perspective view of a conveying device of the workstation in FIG. 1.

With further reference to FIG. 2, the conveying device (20) is mounted on the base (10) and comprises a rail (21), a moving base (22), a motor (222), a pushing rod (23) and two rotating rods (24). The rail (21) is mounted on and arranged parallelly with the base (10). The moving base (22) is movably mounted on the rail (21). The motor (222) is mounted on the moving base (22) to drive the moving base (22) to move along the rail (21) with a transmission of a transmission device (224). The pushing rod (23) is securely attached to the moving base (22) and corresponds to and is parallel with the top of the base (10) to push a worked object to move along the base (10).

Figure 3:
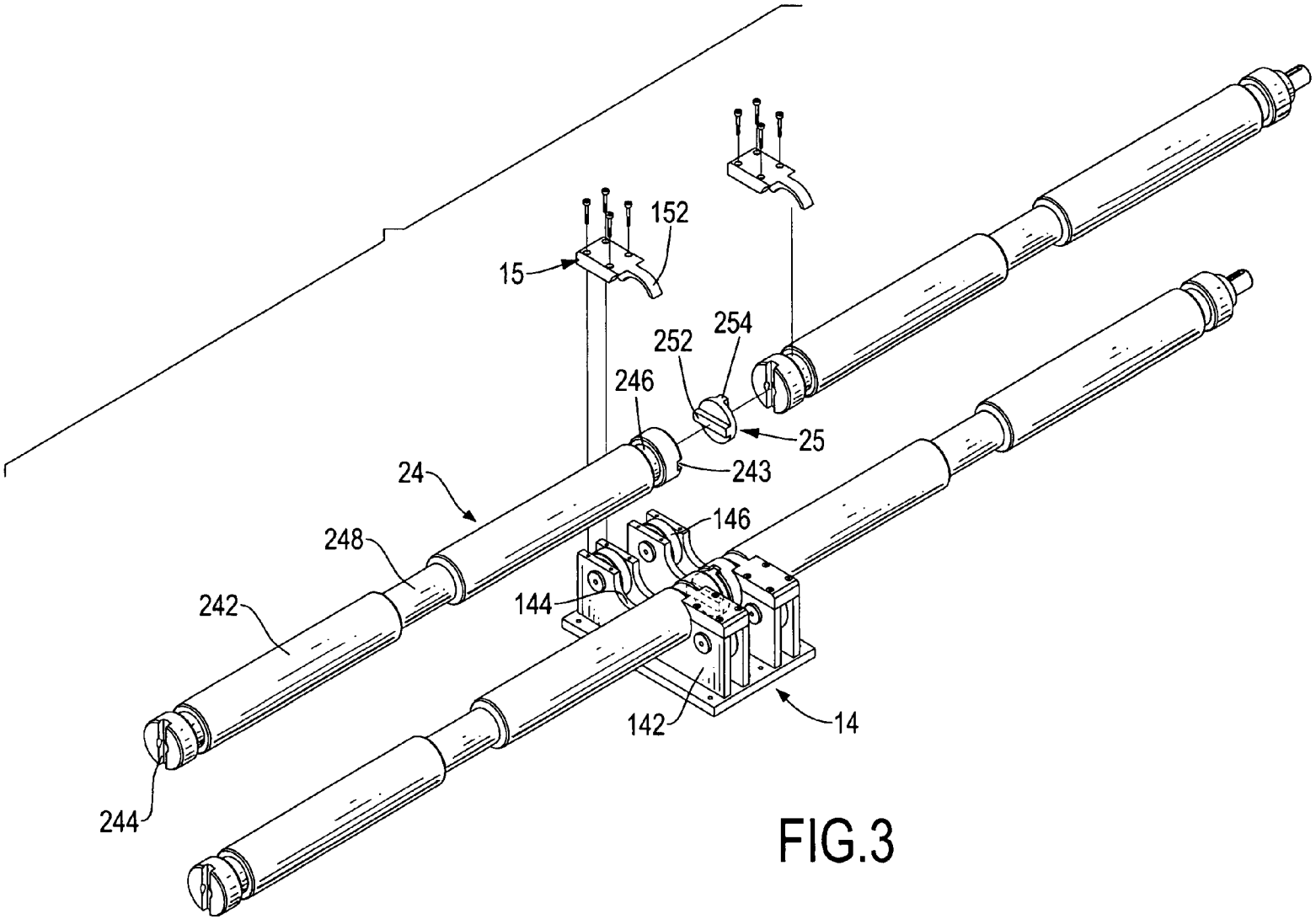
FIG. 3 is an exploded perspective view of connecting rods of two rotating rods and a rod holder of the workstation in FIG. 1.

With further reference to FIG. 3, the rotating rods (24) are rotatably mounted on the top of the base (10) and are parallel with each other. The pushing rod (23) is located at a position above and between the rotating rods (24). With further reference to FIG. 5, each rotating rod (24) may be divided into two segments aligning with each other and located respectively at two sides of the working device (40). Each rotating rod (24) is composed of multiple connecting rods (242) and multiple elements (25). The connecting rods (242) are combined with each other, and the connecting elements (25) are mounted respectively between the connecting rods (242) to connect adjacent connecting rods (242) together. To connect the connecting rods (242) with the connecting elements (25), each connecting rod (242) has two ends and two engaging recesses (243,244) defined respectively in the ends. Each connecting element (25) has two sides and each side comprises an engaging rib (252,254) engaging with the engaging recess (243,244) in one end of a corresponding connecting rod (242). In a preferred embodiment, the engaging ribs (252,254) on each connecting element (25) has an angle between the engaging ribs (252,254), and the engaging ribs (252,254) on each connecting element are preferably perpendicular to each other. With the engagements of the engaging recesses (243,244) in the connecting rods (242) and the engaging ribs (252,254) on the connecting elements (25), the connecting rods (242) are connected together to form a rotating rod (24) and rotates with each other.

In addition, multiple rod holders (14) are mounted on the top of the base (10) to hold the rotating rods (24) on the base (10), and each rod holder (14) comprises two rod brackets (142). The rod brackets (142) are mounted parallelly with each other, and each rod bracket (142) has a top and two cavities (144) defined in the top of the rod bracket (142) to respectively and rotatably hold ends of corresponding connecting rods (242) inside. Each rod holder (14) further comprises multiple caps (15) attached to the rod brackets (142) to keep the corresponding connecting rods (242) from escaping from the cavities (144). Each connecting rod (242) has two annular recesses (246) defined near the ends of the connecting rod (242). Each cap (15) has a curved pawl (152) extending from the cap (15) and engaging with one of the annular recesses (246) in a corresponding connecting rod (242) to hold the corresponding connecting rod (242) on the corresponding rod bracket (142).

Additionally, each rod holder (14) has multiple rollers rotatably mounted on the rod brackets (142) and contacting with the corresponding connecting rods (242) to make the rotating rods (24) to rotate at a lowered friction. An annular middle recess (248) is defined in a middle of each connecting rod (242) to allow a user to take a worked object from the rotating rods (24) easily and conveniently.

Figure 4:
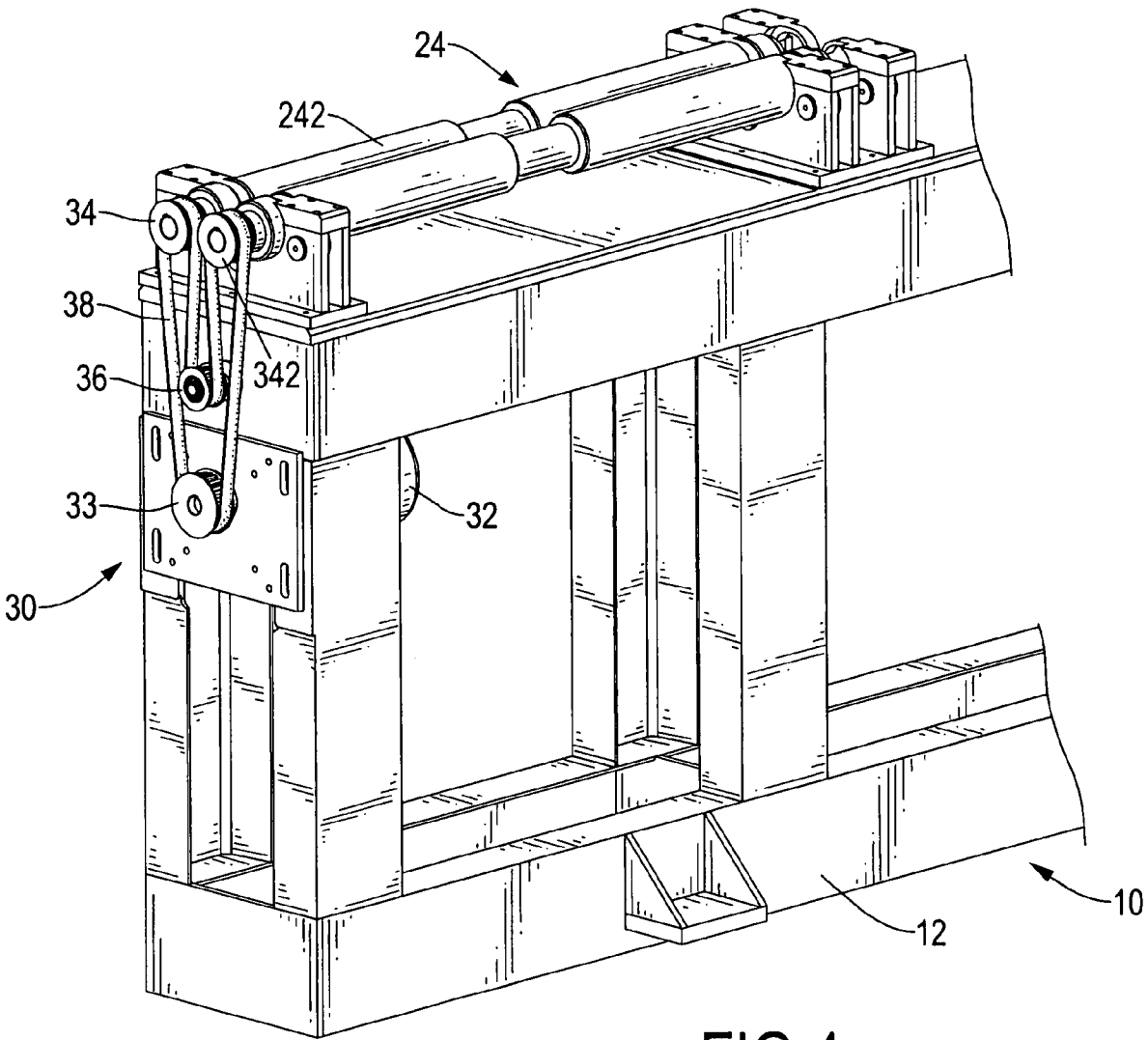
FIG. 4 is a perspective view of a driving device of a driving assembly of the workstation in FIG. 1.
Figure 7:
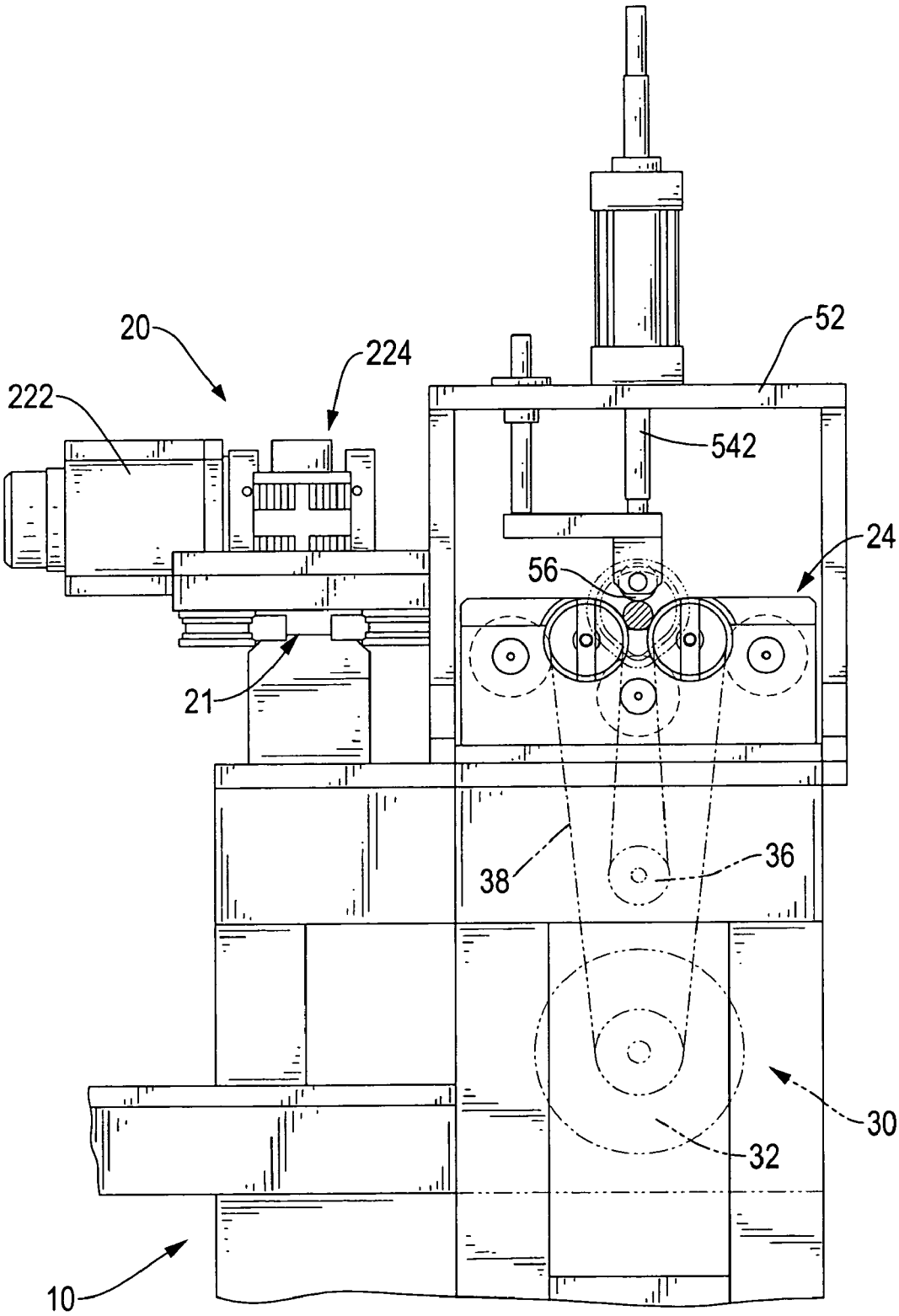
FIG. 7 is an operational side plan view of the workstation in FIG. 1.

The driving assembly (30) is mounted on the base (10) to drive the rotating rods (24) to rotate along a same direction. With reference to FIGS. 1, 4 and 7, with the rotating rods (24) being divided into two segments, the driving assembly comprises two driving devices (30) mounted respectively at two ends of the base (10) to respectively drive the segments of the rotating rods (24) to rotate. If the rotating rods (24) are not divided into two segments but are entire combined rods along the whole base (10), only one driving device (30) is needed. Each driving device (30) comprises a driving motor (32), a driving wheel (33), two driven wheels (34,342), a fly wheel (26) and a belt (38). The driving motor (32) is securely mounted on the base (10). The driving wheel (33) is rotatably mounted on the base (10) and is connected to and driven by the driving motor (32). The driven wheels (34, 342) are coaxially and respectively mounted on the rotating rods (24) at ends corresponding to the driving device (34). The fly wheel (36) is rotatably mounted on the base (10) at a location between the driven wheels (34,342). The belt (38) is mounted around the driving wheel (33), the driven wheels (34,342) and the fly wheel (36).

When the driving motor (32) is switched on, the driving wheel (33) is rotated and the driven wheels (34,342) and the fly wheel (36) are driven to rotate with the transmission of the belt (38). With the fly wheel (36) being arranged at a location between the driven wheels (34,342), the driven wheels (34,342) rotate along a same direction, such that the rotating rods (24) connected with the driven wheels (34,342) also rotate along the same direction.

Figure 6:
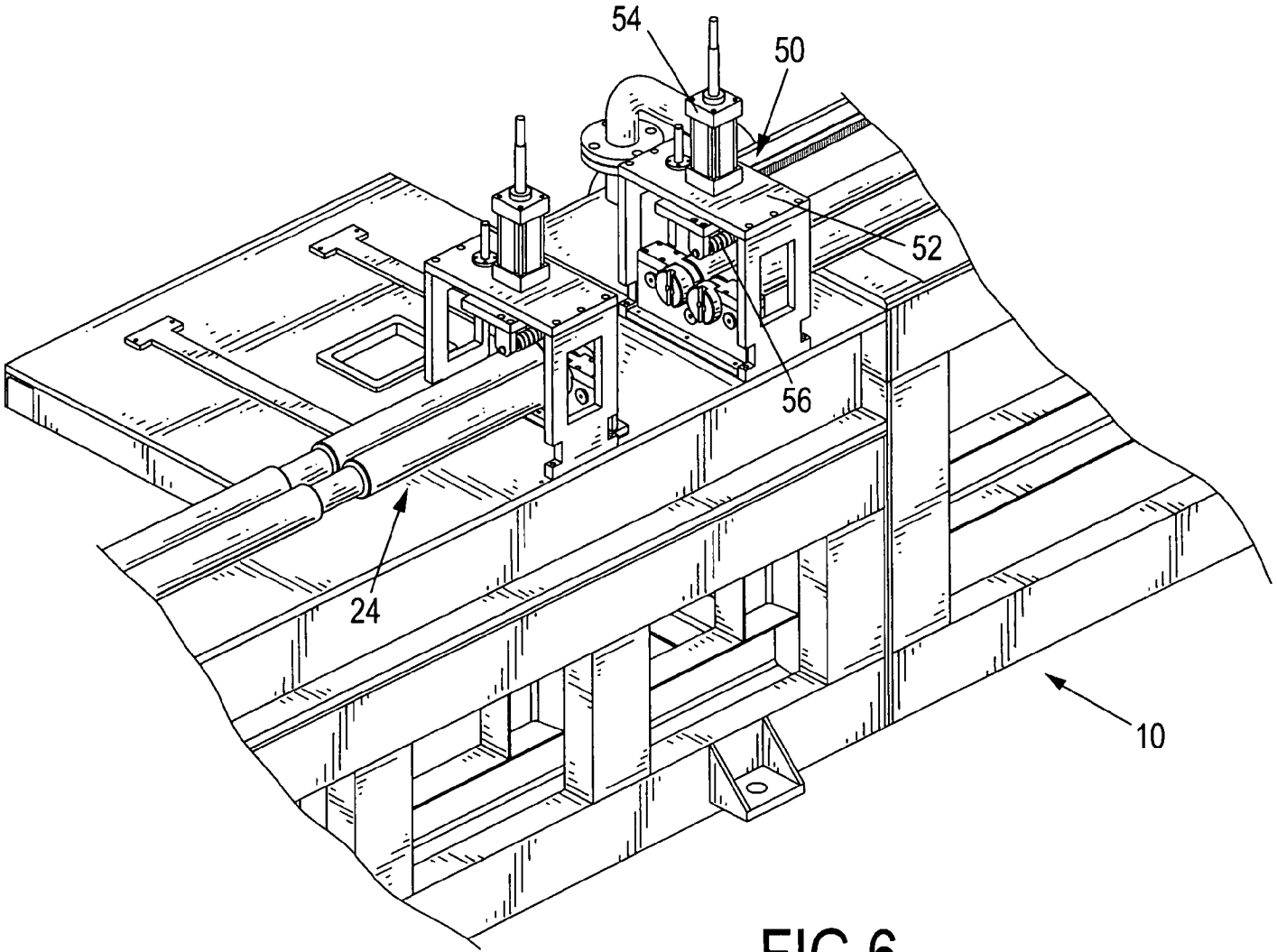
FIG. 6 is a perspective view of the base and the positioning device s of the workstation in FIG. 5.

With reference to FIGS. 1, 5 and 6, at least one positioning device (50) is mounted on the top of the base (10) adjacent to the working device (40). Each positioning device (50) comprises a positioning bracket (52), a cylinder (54) and a positioning element (542). The positioning bracket (52) is securely mounted on the top of the base (10). The cylinder (54) is mounted on the positioning bracket (42) and has an extension rod (542). The positioning element (56) is securely attached to the extension rod (542). In a preferred embodiment, the positioning element (56) has a thread formed on the positioning element (56).

In operation, with reference to FIGS. 1, 2 and 5 to 7, a worked object, such as a threaded rod is held and supported on the rotating rods (24) and abuts against the pushing rod (23). The motor (222) of the conveying device (20) is switched on to make the moving base (22) to move along the rail (21) with the transmission of the transmission device (224), such that the worked object is pushed to move along the rotating rods (24) by the pushing rod (23). When the driving motors (32) of the driving assembly are switched on, the rotating rods (24) are driven to rotate along a same direction by the driving assembly. Accordingly, the worked object will rotate with the rotating rods (24) at a slow speed when the worked object is moved relative to the base (10).

When the worked object is pushed to pass through the working device (40), a desired manufacturing process is applied to the worked object with the working device (40). With the rotation of the worked object, the manufacturing process can be evenly applied to the whole worked object. Furthermore, the cylinders (54) on the positioning devices (50) are actuated to extend the extension rods (542) toward the rotating rods (24) and to make the positioning elements (56) abutting against the worked object. Accordingly, the worked object can be conveyed along the rotating rods (24) smoothly. The threads on the positioning elements (56) can engage with the thread on the threaded rod to keep the thread on the threaded rod from being damaged by the compression of the positioning elements (56).

Because the base (10) is composed of multiple assembled supporting frames (12) and the rotating rods (24) are respectively composed of multiple connecting rods (242), the lengths of the base (10) and the rotating rods (24) are individually adjustable in size based on different worked objects. Therefore, the workstation in accordance with the present invention can fit with different worked objects and is versatile in use.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A workstation comprising:

a base having a top and composed of multiple supporting frames;

a conveying device mounted on the base and comprising a rail mounted on and arranged parallelly with the base;

a moving base movably mounted on the rail;

a motor mounted on the moving base to drive the moving base to move along the rail;

a pushing rod securely attached to the moving base and corresponding to and parallel with the top of the base; and two rotating rods rotatably mounted on the top of the base and parallel with each other, each rotating rod composed of multiple connecting rods combined with each other; and multiple connecting elements mounted respectively between the connecting rods to connect adjacent connecting rods together;

a driving assembly mounted on the base to drive the rotating rods to rotate along a same direction; and a working device mounted on the base to process a manufacturing process to a worked object.

2. The workstation as claimed in claim 1, wherein each connecting rod has two ends and two engaging recesses defined respectively in the ends and an annular middle recess defined in a middle of the connecting rod;

each connecting element has two sides and each side comprises an engaging rib engaging with the engaging recess in one end of a corresponding connecting rod.

3. The workstation as claimed in claim 2, wherein the engaging ribs on each connecting element has an angle between the engaging ribs.

4. The workstation as claimed in claim 3, wherein the engaging ribs on each connecting element are perpendicular to each other.

5. The workstation as claimed in claim 4, wherein the driving assembly comprises two driving devices mounted respectively at two ends of the base and each driving device comprises a driving motor securely mounted on the base;

a driving wheel rotatably mounted on the base and connected to and driven by the driving motor;

two driven wheels coaxially and respectively mounted on the rotating rods at ends corresponding to the driving device;

a fly wheel rotatably mounted on the base at a location between the driven wheels; and a belt mounted around the driving wheel, the driven wheels and the fly wheel.

6. The workstation as claimed in claim 5 further comprising multiple rod holders mounted on the top of the base to hold the rotating rods and each comprising two rod brackets mounted parallelly with each other and each having a top and two cavities defined in the top of the rod bracket to respectively and rotatably hold ends of corresponding connecting rods inside.

7. The workstation as claimed in claim 6, wherein each rod holder further comprises multiple caps attached to the rod brackets to keep the corresponding connecting rods from escaping from the cavities;

each connecting rod has two annular recesses defined near the ends of the connecting rod; and each cap has a curved pawl extending from the cap and engaging with one of the annular recesses in a corresponding connecting rod.

8. The workstation as claimed in claim 7, wherein each rod holder has multiple rollers rotatably mounted on the rod brackets and contacting with the corresponding connecting rods.

9. The workstation as claimed in claim 8 further comprising at least one positioning device mounted on the top of the base and each one of the at least one positioning device comprising a positioning bracket securely mounted on the top of the base;

a cylinder mounted on the positioning bracket and having an extension rod; and a positioning element securely attached to the extension rod.

10. The workstation as claimed in claim 9, wherein the positioning element of each one of the at least one positioning device has a thread formed on the positioning element.

11. The workstation as claimed in claim 1, wherein the driving assembly comprises two driving devices mounted respectively at two ends of the base and each driving device comprises a driving motor securely mounted on the base;

a driving wheel rotatably mounted on the base and connected to and driven by the driving motor;

two driven wheels coaxially and respectively mounted on the rotating rods at ends corresponding to the driving device;

a fly wheel rotatably mounted on the base at a location between the driven wheels; and a belt mounted around the driving wheel, the driven wheels and the fly wheel.

12. The workstation as claimed in claim 11 further comprising multiple rod holders mounted on the top of the base to hold the rotating rods and each comprising two rod brackets mounted parallelly with each other and each having a top and two cavities defined in the top of the rod bracket to respectively and rotatably hold ends of corresponding connecting rods inside.

13. The workstation as claimed in claim 12, wherein each rod holder further comprises multiple caps attached to the rod brackets to keep the corresponding connecting rods from escaping from the cavities;

each connecting rod has two annular recesses defined near the ends of the connecting rod; and each cap has a curved pawl extending from the cap and engaging with one of the annular recesses in a corresponding connecting rod.

14. The workstation as claimed in claim 13, wherein each rod holder has multiple rollers rotatably mounted on the rod brackets and contacting with the corresponding connecting rods.

15. The workstation as claimed in claim 14 further comprising at least one positioning device mounted on the top of the base and each one of the at least one positioning device comprising a positioning bracket securely mounted on the top of the base;

a cylinder mounted on the positioning bracket and having an extension rod; and a positioning element securely attached to the extension rod.

16. The workstation as claimed in claim 15, wherein the positioning element of each one of the at least one positioning device has a thread formed on the positioning element.

17. The workstation as claimed in claim 1 further comprising multiple rod holders mounted on the top of the base to hold the rotating rods and each comprising two rod brackets mounted parallelly with each other and each having a top and two cavities defined in the top of the rod bracket to respectively and rotatably hold ends of corresponding connecting rods inside.

18. The workstation as claimed in claim 17, wherein each rod holder further comprises multiple caps attached to the rod brackets to keep the corresponding connecting rods from escaping from the cavities;

each connecting rod has two annular recesses defined near the ends of the connecting rod; and each cap has a curved pawl extending from the cap and engaging with one of the annular recesses in a corresponding connecting rod.

19. The workstation as claimed in claim 18, wherein each rod holder has multiple rollers rotatably mounted on the rod brackets and contacting with the corresponding connecting rods.

20. The workstation as claimed in claim 1 further comprising at least one positioning device mounted on the top of the base and each one of the at least one positioning device comprising a positioning bracket securely mounted on the top of the base;

a cylinder mounted on the positioning bracket and having an extension rod; and a positioning element securely attached to the extension rod.

* * * * *